United States Patent [19]

Gunderson

[11] Patent Number: 4,832,618

[45] Date of Patent: May 23, 1989

[54] ELECTRIC CORD LOCK

[76] Inventor: Jon R. Gunderson, RR#1, Box 501 A, Ottertail, Minn. 56571

[21] Appl. No.: 162,272

[22] Filed: Feb. 29, 1988

[51] Int. Cl.[4] ..... H01R 13/639

[52] U.S. Cl. ..... 439/369

[58] Field of Search ..... 439/369, 370, 371

[56] References Cited

U.S. PATENT DOCUMENTS

| | | | |
|---|---|---|---|
| 2,461,427 | 2/1949 | Kneebone | 439/369 |
| 2,720,633 | 10/1955 | Westberg | 439/369 |
| 2,721,313 | 10/1955 | English | 439/369 |
| 3,475,716 | 10/1969 | Laig | 439/369 |
| 4,145,105 | 3/1979 | Dobson | 439/369 |
| 4,440,465 | 4/1984 | Elliott et al. | 439/369 |
| 4,664,463 | 5/1987 | Carmo | 439/369 |

OTHER PUBLICATIONS

Copy of picture of Sears, Roebuck and Co. electrical cord lock.

*Primary Examiner*—William Briggs

*Attorney, Agent, or Firm*—Schroeder & Siegfried

[57] ABSTRACT

An electrical cord locking device for holding a pair of interconnected elongated electrical cords securely fastened together at their end plugs, the locking device having a pair of nonconductive generally U-shaped snap-on clamps which are connected in spaced relation to each other by a pair of nonconductive elastic bands. Each generally U-shaped clamp connects to one of the electrical cords at a point adjacent to the end plug of the same which is plugged into the other cord, thereby causing the elastic band which connects the pair of clamps to generate a longitudinal compressive force between the interconnected end plugs of the respective electrical cords. Each generally U-shaped clamp has a restricted middle portion with transverse dimensions less than the transverse dimensions of the electrical cord to which it is attached so as to avoid the clamp from becoming deteched from the electrical cord once it is clamped thereto.

20 Claims, 1 Drawing Sheet

ELECTRIC CORD LOCK

DESCRIPTION

Background of the Prior Art

The invention disclosed herein relates generally to locking devices for holding a pair of interconnected items together, and more specifically to locking devices for holding a pair of interconnected electrical cords together so as to prevent the same from becoming detached at undesirable times.

Quite often, a person using an electrical tool needs to use the tool in an area which is remote from an electrical outlet. Because industry standards for electrical tools quite often require the tools to have relatively short electrical cords extending therefrom, the users of such tools need to plug the tools into electrical extension cords which can reach remote electrical outlets. In fact, it is not uncommon for an individual to string several electrical cords together when that person does not have a single electrical cord which can reach the remote electrical outlet. Thus, quite often there can be several interconnected adjacent electrical cords.

The problem which this invention addresses itself to is the common problem which people often experience when a pair of interconnected electrical cords become disconnected at an inopportune time. For example, a person may be working with an electrical power tool on the roof of a building when the extension cord to which the power tool is attached becomes snagged on something, thereby creating an unexpected tug on the electrical cord and causing the electrical power tool and the electrical extension cord to disconnect.

The problem of disconnecting extension cords has been a continuing frustration for many individuals who use electric power tools or other items which need extension cords on a regular basis. In the past, it has been quite common for users of electrical cords to tie the adjoining electrical cords into a knot at a point near the interconnection of the cord plugs, thereby diverting the tensional forces which commonly cause the electrical cord plugs to disconnect to the knot rather than the interconnection of the cords. However, there are many problems associated with tieing knots in the electrical cords. Such knots in the electrical cords place an undue stress on the electrical wiring contained in such cords, and also tend to shorten the effective length of the extension cord which may be needed to reach the areas where the person is using an electrical tool. Furthermore, it is time consuming for a person to tie and untie knots in the electrical cords.

Thus, it is evident that there is a substantial need for a means of preventing interconnected electrical cords from disconnecting due to some unexpected tensional force thereon. The present invention solves this problem by providing a releasable locking means which clamps to each electrical cord and creates a continuous compressive force between their interconnected end plugs. The present invention eliminates the need for tieing the electrical cords together, and relieves the frustration in time consumption involved with having to re-connect electrical cords which have inadvertently been disconnected.

BRIEF SUMMARY OF THE INVENTION

The present invention is a releasable locking means for locking a pair of adjacent interconnected electrical cords together so that the same will not become disconnected by minor tensional forces. The present invention is comprised of a pair of generally U-shaped fasteners or clamps connected together by a pair of elastic bands, each opposite end of each band being connected to one transverse side of a clamp.

Each clamp is constructed to receive an insulated cord portion within the diverging ends of its clamping jaws and to seat the same at its innermost concaved end. The outer most portions of each clamp which define the open or diverging end thereof provide a channeling means for easily sliding the electrical cord into the clamp. The middle portion of each clamp is restricted so that its transverse dimensions are generally less than the outer transverse dimensions of the electrical cord. Such recessed dimensions make it necessary for the user of the locking device to push the electrical cord past the recessed middle portion of each clamp, thereby causing each respective electrical cord to snap into its seated releasably locked position adjacent the innermost end of the U-shaped clamp which is connected thereto.

Each clamp is attached to opposite interconnected electrical cords at a position adjacent to the connecting end plug of the same. Once connected, the elastic bands which are connected between the clamps create a compressive force between the clamps, thereby causing the clamps to bear against the end plug of each respective electrical cord so as to provide a continuous compressive force between the interconnected plugs.

As shown, each clamp is constructed of a generally nonconductive material, such as a resilient plastic. Similarly, each elastic band is fabricated of a flexible nonconductive synthetic material. Since the bands which connect the clamps are formed of a flexible elastic material, when it is desired to use the present invention on electrical cords having smaller end plugs, by rotating one or both of the clamps 360° inwardly towards the opposite clamp, each elastic band connected to the rotated clamp will flip over and lie in a reversed overlapping relation with itself at its respective point of connection to that clamp. By so doing, the distance between each clamp is effectively reduced so as to facilitate the use of the present invention with varying sizes of electrical cord plugs.

Thus, it can be seen that the present invention provides an easily attachable locking means for preventing adjacent interconnected electrical cords from becoming disconnected. It can also be seen that the use of such U-shaped clamps provides a means which is easily releasable when the user of the same has completed his task and wishes to disconnect the cords. It is readily apparent that the invention claimed and disclosed herein has many advantages over prior methods of preventing electrical cords from disconnecting at inopportune times.

DETAILED DESCRIPTION OF THE INVENTION

Figure 1:
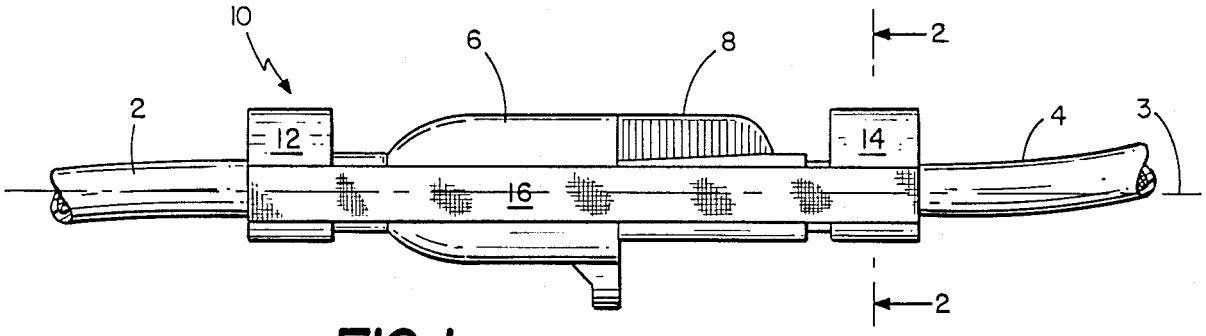
FIG. 1 shows a side elevational view of the electrical cord locking device which is the subject matter of this invention as it is used in connection with a pair of interconnected electrical cords.

Shown in FIG. 1 is a side elevational view of a pair of electrical cords 2 and 4 having a longitudinal axis 3 and respective end plugs 6 and 8 which are interconnected to make electrical continuity therethrough. An electrical cord locking device 10, which is the subject matter of this invention, is connected to each electrical cord 2 and 4 adjacent each cord's respective end plug 6 and 8, and extends therebetween. The basic function of the electrical cord locking device 10 is to prevent undesirable separation between electrical cords 2 and 4.

Figure 3:
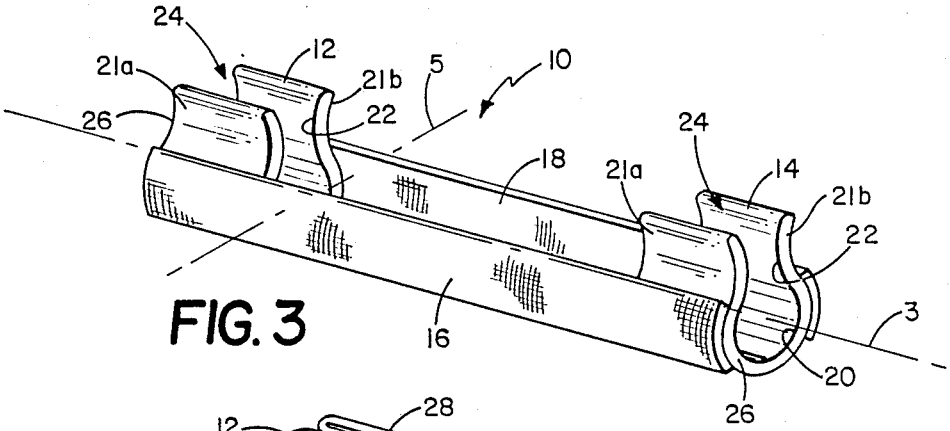
FIG. 3 is a perspective view of the present invention illustrating the generally U-shaped clamps with recessed middle portions and elastic bands interconnecting the same.

More specifically, the locking device 10 is comprised of a pair of fasteners or clamps 12 and 14 which are connected together in spaced relation by a pair of flexible, elastic bands 16 and 18. As best shown in FIG. 3, each clamp 12 and 14 is an elongated generally U-shaped channel member, each of which is defined by a generally concaved or arcuately shaped closed end portion 20 and a pair of laterally spaced integrally formed free end portions, 21*a* and 21*b*, extending outwardly therefrom in diverging relation. Each free end portion, 21*a* and 21*b*, is generally convexly shaped in opposite directions such that the crest of each free end portion is adjacent the crest of the oppositely disposed free end portion, thereby creating a restricted middle portion 22 and an open receiving end portion 24 for each clamp 12 and 14.

Figure 2:
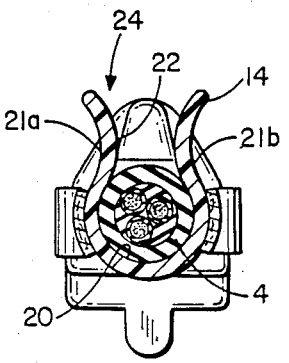
FIG. 2 is a sectional view of the present invention as it is connected to a pair of electrical cords, taken through lines 2—2 of FIG. 1.

As shown in FIG. 2, each clamp 12 and 14 is designed such that each electrical cord, 2 or 4, may be received by the open end 24 of one clamp. By exerting pressure on an electrical cord against the middle portion 22 of a clamp, the cord may be snapped through the restricted middle portion 22 and become seated in a generally releasable locked position in the closed end portion 20 of the respective clamp.

It can be seen from FIG. 2 that each clamp 12 and 14 is generally designed to have a transversely restricted middle portion 22, wherein the minor transverse dimensions between the spaced lateral free end portions 21*a* and 21*b* is generally less than the diameter or major tranverse dimension of the electrical cord to be received therein. The opposite convexly shaped free end portions 21*a* and 21*b* also provide a channeling effect at the open end 24 of each clamp 12 and 14. Thus, when desired, an electrical cord may be quickly received in open end portion 24 and snapped through the restricted middle portion 22 into its seated position in closed end portion 20. Each clamp 12 and 14 is constructed of a generally nonconductive material, such as plastic, for safety purposes.

Each elastic band, 16 and 18, as best shown in FIG. 3, is formed of a generally nonconductive, flexible and elastic synthetic material. Each band extends between clamps 12 and 14 and is connected at opposite ends thereof to one of the clamps. For example, elastic band 16 is connected at one end to clamp 12 and at its other end to clamp 14. Elastic bands 16 and 18 are each connected to one of the opposite lateral outside faces of each clamp 12 and 14. Preferably, each band 16 and 18 is secured to each clamp along the entire length of the same, such that each end of each band 16 and 18 lies adjacent the outer end 26 of each clamp. However, it will be noted that the invention will still function properly if the elastic bands are not secured along the entire length of each clamp 12 and 14.

Figure 4:
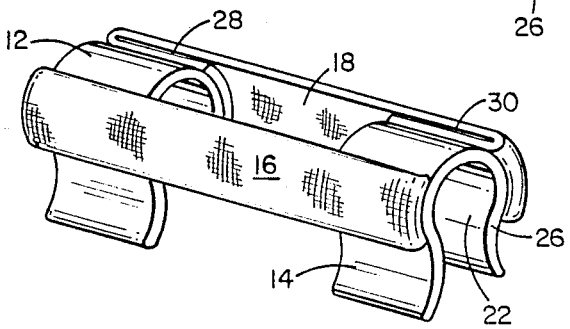
FIG. 4 is a perspective view of the present invention with each clamp rotated 360 degrees inwardly towards the opposite clamp and illustrating the reverse overlapping of each elastic band at its respective point of connection to each clamp.

FIG. 4 shows an alternative configuration of the same electric cord locking device as shown in FIG. 3. As shown in FIG. 4, because of the flexible elastic nature of bands 16 and 18, each clamp 12 and 14 is capable of being rotated longitudinally 180°, thereby causing each elastic band 16 and 18, which are connected to each clamp 12 and 14, to double over and overlap the original end portion of itself at the point where it is connected to the clamp (examples of such overlapping are shown at points 28 and 30 in FIG. 4). By rotating one or both clamps in such a manner as shown in FIG. 4, the length of the electrical cord locking device 10 is effectively decreased, thereby facilitating use of the invention with electrical cords which have smaller end plugs.

In operation, once a person has interconnected the end plugs 6 and 8 of a pair of electrical cords 2 and 4, the electrical cord locking device 10 may be attached by simply snapping one electrical cord into clamp 12 so that the cord is seated in the lower closed portion 20, and then snapping the other electrical cord into clamp 14 so that that cord is seated in the respective closed end portion 20 of clamp 14. Because the initial length of the elastic bands 16 and 18 are shorter than the length of the end plugs 6 and 8 after being interconnected, when clamps 12 and 14 are clamped onto their respective cords, the elastic bands 16 and 18 will be in a stretched condition, thereby creating a self-adjusting compressive force between clamps 12 and 14. The compressive force created by elastic band 16 and 18 will cause clamps 12 and 14 to bear against the respective end plug of the cord to which each is attached, thereby transferring the compressive force to the interconnection between the end plugs 6 and 8 which connect electrical cords 2 and 4. Thus, the continuous compressive force at the interconnection of the two electrical cords prevents any severance of the electrical cords during use of the same.

If a person using the electrical cord locking device 10 discovers that the elastic bands are not in a stretched condition when clamp 12 and 14 are attached to two interconnected cords, thereby preventing a compressive force from acting on the interconnection between the two electrical cords, one or both (as needed) clamps 12 and 14 may be rotated longitudinally 180° about a generally transverse axis such as that designated as point 5, so as to cause the elastic bands to overlap and double back as shown in FIG. 4. By so doing, the effective length of the electrical cord locking device 10 is reduced to accommodate electrical cords having smaller end plugs.

When severance of the two electrical cords is desired, one or both clamps 12 and 14 may simply be released or unsnapped from its locked position, thereby relieving the compressive force between the two end plugs, and allowing the cords to be easily separated.

In considering this invention, it should be remembered that the present disclosure is illustrative only, and that the scope of the invention should be determined from the appended claims.

What is claimed is:

1. An apparatus for retaining a pair of electrical cords having end plugs and a longitudinal axis in connected relation, said apparatus comprising:

(a) a pair of spaced and opposed releasable fasteners, each said fastener being constructed and arranged to be pivotally adjustable about an axis generally transverse to said longitudinal axis toward said opposing fastener to accommodate electrical cords having varying sizes of end plugs, and to engage one of the electrical cords; and (b) a flexible elastic connecting means for connecting said fasteners together, said connecting means being constructed and arranged to cause a sufficient compressive force between the adjoining electrical cords so as to prevent the same from becoming undesirably disconnected.

2. The structure defined in claim 1, wherein each of said fasteners is generally U-shaped.

3. The structure defined in claim 1, wherein said elastic connecting means is constructed of a generally nonconductive synthetic material.

4. The structure defined in claim 1, wherein each of said fasteners is constructed and arranged to snap onto the electrical cord at a point adjacent each cord's respective end plug.

5. The structure defined in claim 1, wherein each of said fasteners is constructed of a generally nonconductive material.

6. The structure defined in claim 1, wherein each of said fasteners is a channel member having an open receiving end and a closed end, said closed end having inner transverse dimensions which are approximately equal to the outer transverse dimensions of the electrical cord, and said receiving end having inner transverse dimensions which decrease towards said closed end.

7. The structure defined in claim 6, wherein said receiving end of each said channel member has inner transverse dimensions adjacent to said closed end which are less than the outer transverse dimensions of the electrical cord to which each said respective channel member is attached.

8. The structure defined in claim 1, wherein said connecting means is further comprised of a pair of synthetic non-conductive bands, each said band being connected at one end to one of said fasteners, and at their other end to said other fastener.

9. The structure defined in claim 8, wherein each said elastic band connected to said fasteners is disposed in reversed doubled-back overlapping relation with itself at its respective point of connection with at least one of said fasteners to effectively shorten the distance between said fasteners when desired.

10. The structure defined in claim 2, wherein each said U-shaped fastener has a transversely restricted middle portion.

11. The structure defined in claim 2, wherein each said U-shaped fastener is comprised of a closed curved arcuate portion having a pair of laterally spaced free end portions cantilevered therefrom, each said free end portion being convexly shaped in opposite directions, whereby the crest of each said free end portion is adjacent the crest of the other said free end portion.

12. An apparatus for locking a pair of electrical cords having end plugs and a longitudinal axis together at their interconnection, said apparatus comprising:

(a) a pair of spaced and opposed fasteners, each constructed and arranged to engage an electrical cord and to be pivotally adjustable about an axis generally transverse to said longitudinal axis toward said opposing fastener to effectively shorten the length of the locking apparatus, and at least one of said fasteners being constructed and arranged to be releasable from the electrical cord to which it is attached; and (b) a means for connecting said fasteners together in spaced relation when said fasteners are in a cord-engaging position, said connecting means providing a self-adjusting compressive force at the interconnection of the adjoining cords, thereby preventing the cords from separating until separation of the same is desired.

13. The structure defined in claim 12, wherein each said fastener is generally U-shaped.

14. The structure defined in claim 13, wherein each said U-shaped fastener has a transversely restricted middle portion.

15. The structure defined in claim 12, wherein each said fastener is a snap-on clamp capable of being removed from the cord to which it is attached.

16. The structure defined in claim 12, wherein said connecting means is made of non-conductive elastic material.

17. The structure defined in claim 12, wherein each said fastener is a channel member having a receiving end and a closed end, said closed end having inner transverse dimensions which are approximately equal to the outer transverse dimensions of the electrical cord to be received thereby, and said receiving end having inner tranverse dimensions which lessen towards said closed end.

18. The structure defined in claim 17, wherein each said receiving end of each said channel member has inner transverse dimensions adjacent to said closed end which are less than the outer transverse dimensions of the electrical cord to which each respective channel member is attached.

19. An apparatus for holding a pair of electrical cords having a longitudinal axis in interconnecting relation, comprising:

(a) a pair of electrical cords, one said cord having at least a male plug, and the other said cord having at least a female plug, said cords being constructed and arranged to innerconnect said respective male and female plugs to provide electrical continuity therethrough;

(b) a pair of spaced and opposed fasteners, each constructed and arranged to engage one of said cords and to be pivotally adjustable about an axis generally transverse to said longitudinal axis toward said opposing fastener to accommodate varying sizes of said plugs, and at least one of said fasteners being constructed and arranged to be releasable from said electrical cord to which it is attached; and (c) a flexible elastic means for connecting said fasteners together at least when said fasteners are in cord-engaging position, said elastic connecting means being constructed and arranged to cause a compressive force to be exerted between said plugs, thereby preventing said plugs of said cords from separating until separation is desired.

20. The structure defined in claim 18, wherein said fasteners are generally U-shaped in configuration and constructed and arranged to clamp onto said cords in a releasable locking relation.

* * * * *